US007899571B2

(12) United States Patent
Basim et al.

(10) Patent No.: US 7,899,571 B2
(45) Date of Patent: Mar. 1, 2011

(54) PREDICTIVE METHOD TO IMPROVE WITHIN WAFER CMP UNIFORMITY THROUGH OPTIMIZED PAD CONDITIONING

(75) Inventors: Gul Bahar Basim, Plano, TX (US); Serkan Kincal, Mountain View, CA (US); Eugene C. Davis, McKinney, TX (US)

(73) Assignee: Texas Instruments Incorporated, Dallas, TX (US)

( * ) Notice: Subject to any disclaimer, the term of this patent is extended or adjusted under 35 U.S.C. 154(b) by 342 days.

(21) Appl. No.: 12/265,242

(22) Filed: Nov. 5, 2008

(65) Prior Publication Data

US 2010/0112900 A1 May 6, 2010

(51) Int. Cl.

| | |
|---|---|
| ***G06F 19/00*** | (2006.01) |
| ***B24B 49/00*** | (2006.01) |
| ***B24B 51/00*** | (2006.01) |
| ***B24B 1/00*** | (2006.01) |
| ***H01L 21/302*** | (2006.01) |
| ***H01L 21/461*** | (2006.01) |

(52) U.S. Cl. ..... 700/121; 451/5; 451/56; 438/692

(58) Field of Classification Search ..... 451/5, 451/6, 9, 10, 14, 56, 58; 438/690, 692; 156/345.12; 700/121

See application file for complete search history.

(56) References Cited

U.S. PATENT DOCUMENTS

| | | | | |
|---|---|---|---|---|
| 5,547,417 | A * | 8/1996 | Breivogel et al. | 451/58 |
| 6,113,462 | A * | 9/2000 | Yang | 451/5 |
| 6,126,512 | A * | 10/2000 | Chao et al. | 451/9 |
| 6,495,463 | B2 * | 12/2002 | Halley | 438/690 |
| 6,531,397 | B1 * | 3/2003 | Nagahara et al. | 438/692 |
| 6,667,239 | B2 * | 12/2003 | Saka et al. | 438/692 |
| 7,160,739 | B2 * | 1/2007 | Shanmugasundram et al. | 438/14 |
| 7,314,401 | B2 * | 1/2008 | Chandrasekaran | 451/10 |
| 7,413,986 | B2 * | 8/2008 | Paik | 438/690 |
| 7,481,695 | B2 * | 1/2009 | Saldana et al. | 451/5 |
| 2002/0023719 | A1 * | 2/2002 | Epshteyn et al. | 156/345 |
| 2010/0035518 | A1 * | 2/2010 | Chang et al. | 451/6 |
| 2010/0035525 | A1 * | 2/2010 | Deshpande et al. | 451/56 |

OTHER PUBLICATIONS

Ruey-Shan Guo et al; "Run-to-run control schemes for CMP process subject to deterministic drifts"; Semiconductor Manufacturing Technology Workshop; Publication Year: 2000; pp. 251-258.*

F. G. Shi et al.; "Fundamentals of CMP for IC manufacturing: recent progress"; 5th International Conference on Solid-State and Integrated Circuit Technology Proceedings; Publication Year: 1998; pp. 113-115.*

* cited by examiner

*Primary Examiner*—Crystal J Barnes-Bullock
(74) *Attorney, Agent, or Firm*—Wade J. Brady, III

(57) ABSTRACT

A method of conditioning a CMP polishing pad to attain a desired thickness profile in a polished layer on a wafer is disclosed. The incoming thickness profile of the layer to be polished, the thickness profile of the polishing pad, a polish rate of layer as a function of pressure and the removal rate of polishing pad material by a conditioning block are used to compute a sweep pattern for the conditioning block which will produce a desired thickness profile on the polishing pad. The method may be applied to maintaining the desired profile on the polishing pad during the course of polishing multiple wafers. The pad profile may be adjusted to keep pressure between the pad and the wafer to a safe limit to reduce polishing defects.

18 Claims, 4 Drawing Sheets

PREDICTIVE METHOD TO IMPROVE WITHIN WAFER CMP UNIFORMITY THROUGH OPTIMIZED PAD CONDITIONING

FIELD OF THE INVENTION

This invention relates to the field of integrated circuits. More particularly, this invention relates to methods to improve chemical mechanical polishing processes used in integrated circuit fabrication.

BACKGROUND OF THE INVENTION

Chemical mechanical polishing (CMP) is widely used in integrated circuit (IC) manufacturing for planarizing surfaces of semiconductor wafers at various stages of fabrication. CMP equipment includes a wafer holder, commonly known as a head, which rotates and translates a wafer to be polished while pressing it against a consumable polishing pad, which is also rotating. A polishing slurry, typically an aqueous suspension of abrasive particles and chemicals, is dispensed onto the polishing pad during wafer polishing. A conditioning block, typically possessing an abrasive surface, moves across the polishing pad surface during wafer polishing, removing polishing debris and worn polishing pad material from the polishing pad to maintain a fresh polishing pad surface. Achieving a uniform polished layer of material, for example silicon dioxide, on a wafer surface is commonly hampered by non-uniform IC layer thicknesses on wafers incoming to a CMP operation. As a polishing pad is used for polishing multiple wafers, the pad thickness profile changes due to removal of pad material by the polishing block, resulting in constantly changing polishing rates across wafer surfaces, which produces varying IC layer thickness profiles across each wafer and from wafer to wafer.

SUMMARY OF THE INVENTION

This Summary is provided to comply with 37 C.F.R. §1.73, requiring a summary of the invention briefly indicating the nature and substance of the invention. It is submitted with the understanding that it will not be used to interpret or limit the scope or meaning of the claims.

The instant invention provides a method of conditioning a polishing pad by taking into account a radially averaged thickness of IC layer material to be removed from the wafers during the CMP operation, and taking into account the thickness profile of the polishing pad, and adjusting a sweep pattern of a conditioning block to produce a desired polishing pad thickness profile before polishing wafers. This is accomplished by varying process variables according to known relationships between process parameters to optimize a final polished layer profile and minimize polishing defects. The instant invention also includes a method of maintaining a desired polishing pad thickness profile during a process of sequentially polishing multiple wafers by monitoring the polishing pad thickness profile and adjusting the conditioning block sweep pattern accordingly. The instant invention also includes a method to vary the force of the wafer against the polishing pad to keep the pressure at each point on the wafer below a safe limit to reduce polishing defects.

DETAILED DESCRIPTION

Figure 1:
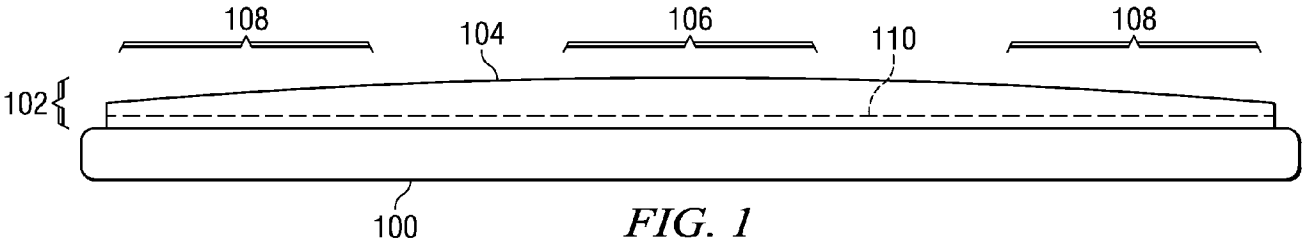
FIG. 1 is a cross-section of a semiconductor wafer with an IC material layer on a top surface of the wafer.

The present invention is described with reference to the attached figures, wherein like reference numerals are used throughout the figures to designate similar or equivalent elements. The figures are not drawn to scale and they are provided merely to illustrate the invention. Several aspects of the invention are described below with reference to example applications for illustration. It should be understood that numerous specific details, relationships, and methods are set forth to provide a full understanding of the invention. One skilled in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The instant invention provides a method of chemical mechanical polishing (CMP) to achieve more uniform polished layers on semiconductor wafers. The method includes a process of initially conditioning a polishing pad by taking into account a radially averaged thickness of IC layer material to be removed from the wafers during the CMP operation, and taking into account the thickness profile of the polishing pad, and adjusting a sweep pattern of a conditioning block to produce a desired polishing pad thickness profile before polishing wafers. The method also includes a process of maintaining a desired polishing pad thickness profile during the course of polishing a multitude of wafers by monitoring the polishing pad thickness profile and adjusting the conditioning block sweep pattern accordingly. A third feature of the inventive method is to vary a head force, which is the force of the wafer against the polishing pad, during polishing each wafer, to keep local pressure below a safe limit at all points across the wafer to reduce polishing defects such as scratches.

An advantage of the instant invention is more uniform polished layers on semiconductor wafers are produced by the inventive method than by other CMP processes. A further advantage is increased wafer throughput consistent with reduced polishing defects compared to other CMP processes.

The term radially averaged thickness is taken to mean an average of multiple measurements of thickness taken at a given radius from a center point, approximately uniformly radially distributed. A radially averaged thickness profile is understood to mean a set of radially averaged thicknesses for multiple radii covering a range from near the center point to near an edge.

FIG. 1 is a cross-section of a semiconductor wafer (100) with an IC material layer (102) on a top surface of the wafer (100). For example, the IC material layer (102) might be silicon dioxide used to fill Shallow Trench Isolation (STI) trenches. In another example, the IC material layer (102) might be low-k dielectric material such as organo-silicate glass (OSG) or carbon-doped silicon oxides (SiCO or CDO) used to insulate metal interconnect layers. In yet another example, the IC material layer (102) might be copper used to form metal interconnect elements. A profile of a radially averaged thickness (104) of the IC material layer (102) is thicker in a center region (106) than in an edge region (108). A desired IC layer thickness profile (110) depicted as a dashed line in FIG. 1, provides a uniform IC layer thickness across the wafer (100). The challenge of a CMP process is to remove more IC layer material from the center region (106) than the edge region (108) so as to leave an IC layer with the desired IC layer thickness profile (110) when the CMP process is completed.

Figure 2:
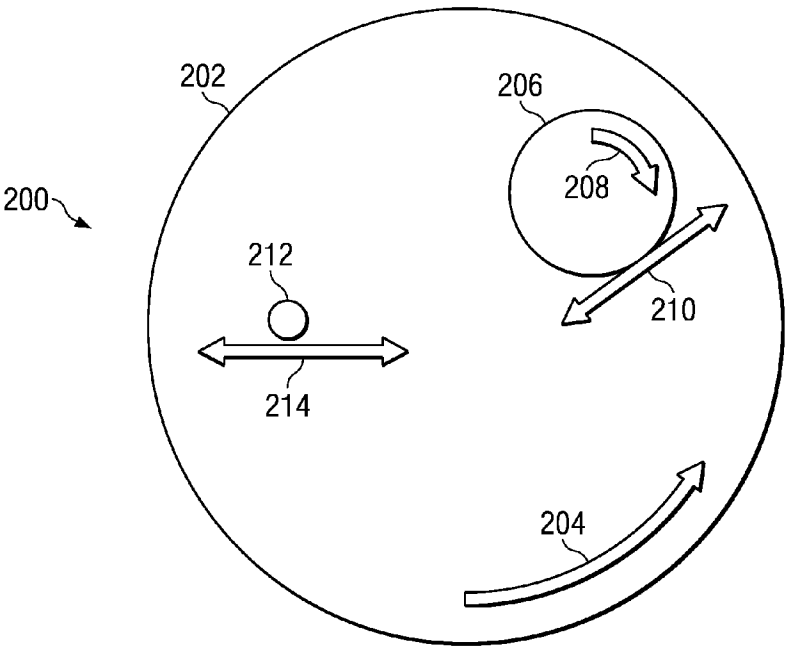
FIG. 2 is a top view of selected elements of a CMP tool.

FIG. 2 is a top view of selected elements of a CMP tool (200). A polishing pad (202) rotates during a polishing operation, as depicted by pad rotation arrow (204). A head (206) holds a semiconductor wafer, not shown in FIG. 2 for clarity, against a top surface of the polishing pad (202). The head rotates, as depicted by head rotation arrow (208) and translates with respect to a center of the polishing pad (202), as depicted by head translation arrow (210), during the polishing operation. Polishing slurry, typically an aqueous suspension of abrasive particles and chemicals, is dispensed onto the polishing pad during the polishing operation by a slurry dispense mechanism, not shown in FIG. 2 for clarity. A conditioning block (212) translates with respect to the center of the polishing pad (202), as depicted by conditioning block translation arrow (214), during the polishing operation and during a pad conditioning operation. During the polishing operation, the conditioning block (212) removes polishing debris and worn polishing pad material from the top surface of the polishing pad (202) to maintain a fresh polishing pad surface. During the pad conditioning operation, the conditioning block (212) removes polishing pad material from the top surface of the polishing pad (202). In the instant invention, the pad conditioning operation provides a desired polishing pad thickness profile.

Figure 3:
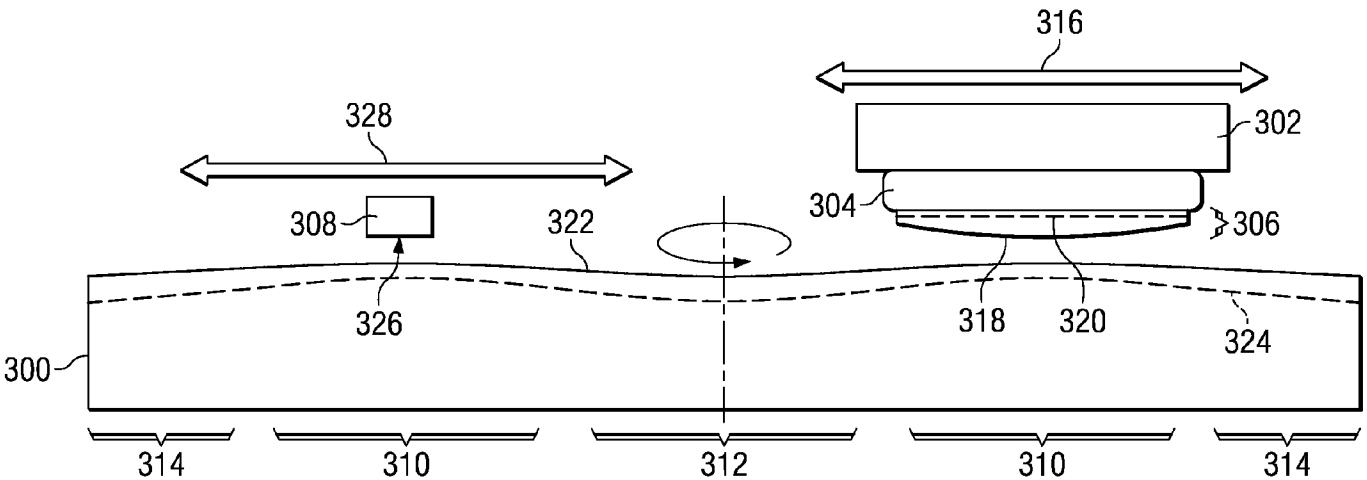
FIG. 3 is a cross-section of a polishing pad, a head holding a wafer with an IC material layer, and a conditioning block.

FIG. 3 is a cross-section of a polishing pad (300), a head (302) holding a wafer (304) with an IC material layer (306), and a conditioning block (308). The polishing pad rotates around a vertical axis through its center. The head (302) moves the wafer (304) through a mid zone (310) into a center zone (312) and edge zone (314) at each end of its traverse, as depicted by head translation arrow (316). A radially averaged thickness profile (318) of the IC material layer (306) is thicker in a center region of the wafer (304) than a desired IC layer thickness profile (320), depicted as a dashed line.

During a CMP operation, material is removed from the IC material layer (306) at a rate that is approximately proportional to a local pressure, between a top surface of the IC material layer (306) and a top surface of the polishing pad (300), times a relative speed between the top surface of the IC material layer (306) and the top surface of the polishing pad (300), at a position of interest on the wafer (304), which is a relationship commonly known as the Preston equation. A constant of proportionality in the foregoing relationship, commonly known as a Preston constant, may be determined empirically, using known CMP calibration methods. The local pressure between the top surface of the IC material layer (306) and the top surface of the polishing pad (300) is increased for thicker regions of the IC material layer (306) and for thicker regions of the polishing pad (300). A relationship between the local pressure and IC layer thickness profile (318) of the IC material layer (306) and pad thickness profile (322) of the polishing pad (300) is a function of a stiffness of the polishing pad (300), and may also be determined empirically using known CMP calibration methods. The relative speed between the top surface of the IC material layer (306) and the top surface of the polishing pad (300) at the position of interest on the wafer (304) may be obtained by known algebraic and trigonometric methods using a rotational speed of the polishing pad (300), a radial position of the wafer (304) with respect to a center of the polishing pad (300), a rotational speed of the wafer (304) and a translational speed of the wafer (304), and a radial distance of the position of interest on the wafer (304) from a center of the wafer (304).

A difference between the IC layer thickness profile (318) and the desired IC layer thickness profile (320) is the IC layer material to be removed in the CMP operation. Knowing the rotational speed of the polishing pad (300), the translational motion pattern of the wafer (304) with respect to a center of the polishing pad (300), and the rotational speed of the wafer (304), it is possible to compute a desired polishing pad profile for a given local pressure. Workers in CMP processing are familiar with the observation that polishing defects such as scratches increase significantly above a critical pressure, which is a function of the details of the CMP tool, polishing pad, polishing slurry, and material being polished. Restricting the local pressure to a safe fraction of the critical pressure, a desired polishing pad profile (324), depicted as a dashed line in FIG. 3, may be computed.

Shaping the polishing pad (300) to the desired polishing pad profile (324) is accomplished by removing pad material from a top surface of the polishing pad using the conditioning block (308) in a conditioning operation. The conditioning block (308) has an abrasive bottom surface (326), commonly including diamond particles, which is pressed against the top surface of the polishing pad (300) while moving laterally between the center region (312) and the edge region (314), as denoted by conditioning block movement arrow (328). A removal rate of polishing pad material is related to a pressure and relative speed between the conditioning block (308) and the polishing pad (300) by the Preston equation, with a second Preston constant, which is also empirically determined. Typically, the conditioning block (308) moves substantially radially across a circle defined by a polishing pad (300), from a central endpoint near a rotational center of the polishing pad (300) to an edge endpoint near an edge of the polishing pad (300), as the polishing pad (300) rotates beneath the conditioning block (308). A local speed of the polishing pad (300) beneath the conditioning block (308) may be estimated as a product of a rotational speed of the polishing pad (300) times a distance of the conditioning block (308) from the rotational center of the polishing pad (300). The relative speed between the conditioning block (308) and the polishing pad (300) may be estimated as a square root of a square of the local speed of the polishing pad (300) beneath the conditioning block (308) plus a square of a linear speed of the conditioning block (308). CMP tools in which a conditioning block does not move substantially radially may require a more detailed expression for estimating relative speed between the conditioning block and a polishing pad, using known trigonometric methods. A radially averaged removal rate of polishing pad material at a particular distance of the conditioning block (308) from the rotational center of the polishing pad (300) may be estimated as the removal rate of polishing pad material using the Preston equation times a width of the conditioning block (308) divided by a length of a circumference of a circle whose radius is the distance of the conditioning block (308) from the rotational center of the polishing pad (300), and multiplied by a fraction of the time the conditioning block (308) is over the particular distance of the conditioning block (308) from the rotational center of the polishing pad (300) during a sweep of the conditioning block (308) from the central endpoint to the edge endpoint.

Using a difference between the pad thickness profile (322) and the desired polishing pad profile (324), and the radially averaged removal rate of polishing pad material at each distance of the conditioning block (308) from the rotational center of the polishing pad (300), a sweep pattern for the conditioning block (308) may be computed.

Figure 4:
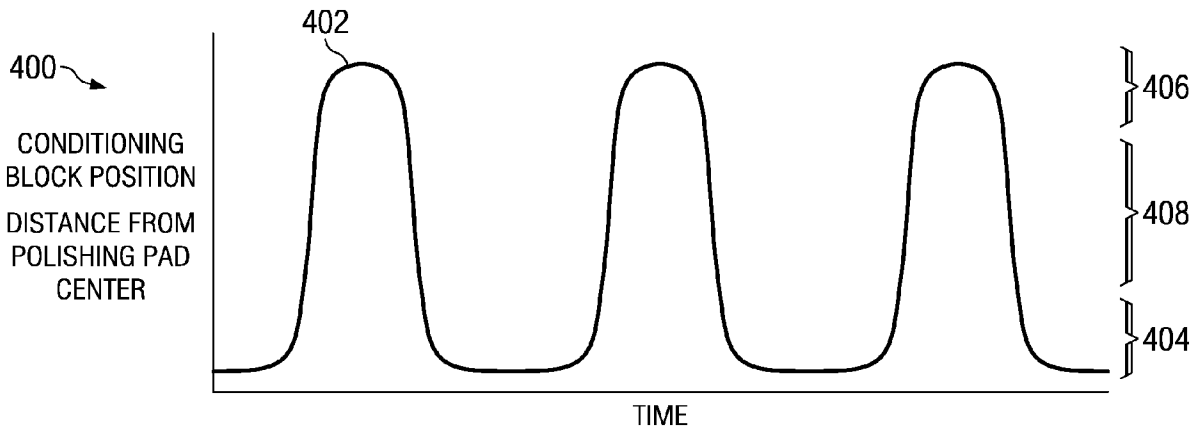
FIG. 4 is a chart of a pre-conditioning sweep pattern for a conditioning block to reshape a new polishing pad to a desired thickness profile.

FIG. 4 is a chart (400) of a pre-conditioning sweep pattern (402) for a conditioning block to reshape a new polishing pad to a desired thickness profile, for example, the polishing pad depicted in FIG. 3. The pre-conditioning sweep pattern (402) specifies the conditioning block to spend more than half a sweep cycle in a region near a central endpoint (404), and spend a significant fraction, approximately a third of the sweep cycle, in a region near an edge endpoint (406), while spending comparatively little time in a mid region (408). Such a pre-conditioning sweep pattern (402) may be expected to remove more polishing pad material from a center region and an edge region of a polishing pad compared to a mid region of the polishing pad.

Figure 5A:
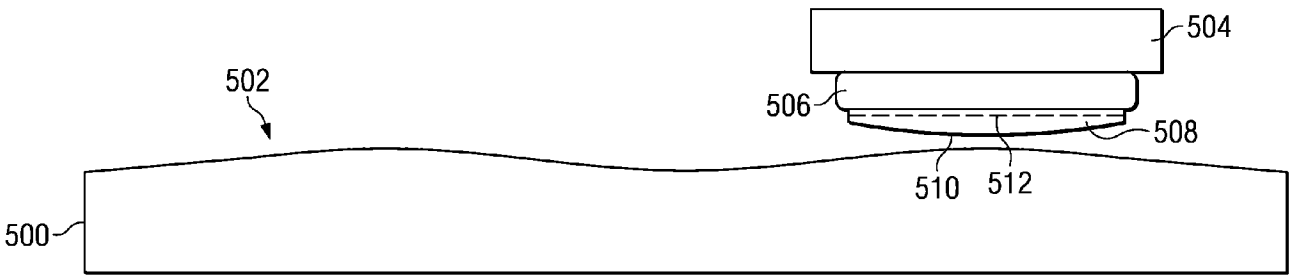
FIG. 5A through FIG. 5C depict successive stages in a CMP operation in which material in an IC layer is removed by a polishing pad with a pad thickness profile substantially equal to a desired pad thickness profile.
Figure 5B:
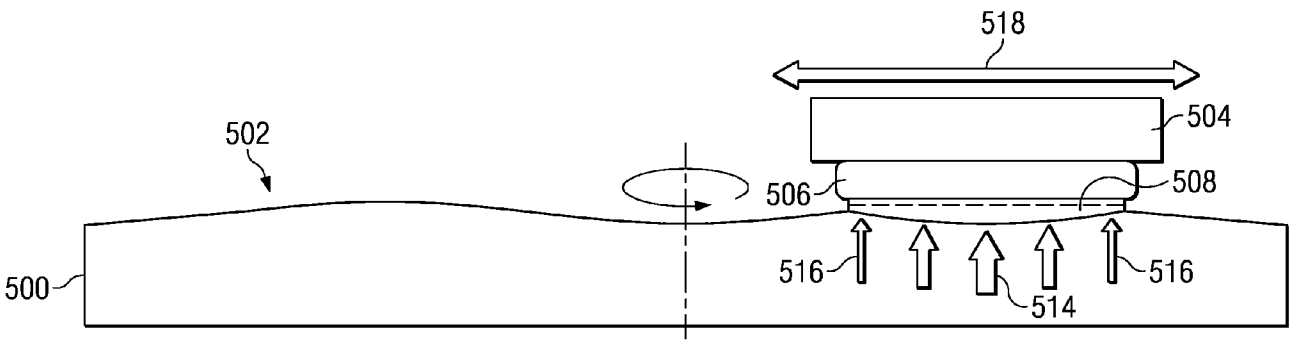
Figure 5C:
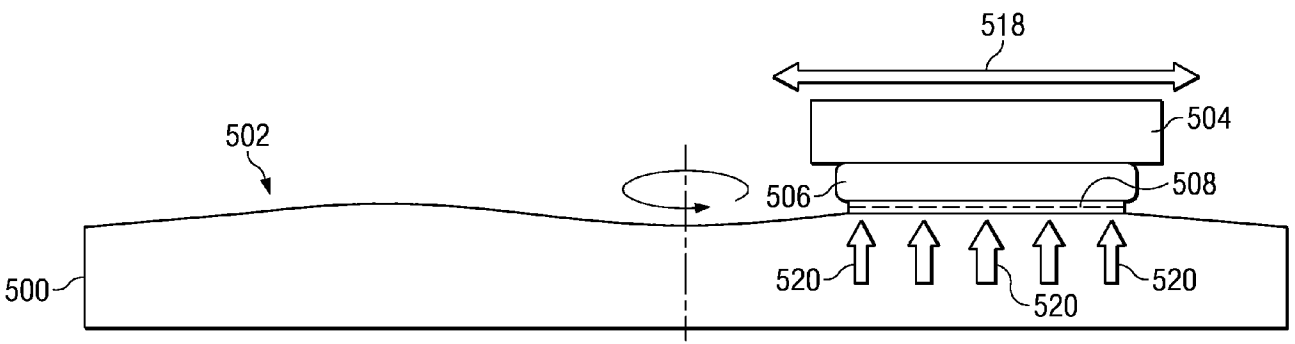

FIG. 5A through FIG. 5C depict successive stages in a CMP operation in which material in an IC layer is removed by a polishing pad with a pad thickness profile substantially equal to a desired pad thickness profile. FIG. 5A depicts the polishing pad, head, wafer and IC layer before polishing is started. The polishing pad (500), shown in a cross-sectional view, has a pad thickness profile (502) substantially equal to a desired pad thickness profile. A head (504) holds a wafer (506) in an inverted orientation above a mid region of the polishing pad (500). An IC layer (508) on a top surface of the wafer (506) has a radially averaged layer thickness profile (510) which is thicker in a central region of the wafer (506) than a desired layer thickness profile (512).

FIG. 5B depicts the CMP operation immediately after polishing has started. The polishing pad (500) rotates around a vertical axis through its center. A top surface of the polishing pad (500) is deformed by contact with the IC layer (508), such that local pressure between the polishing pad (500) and the IC layer (508) is higher in the central region of the wafer (506) than in an edge region of the wafer, as depicted by central region pressure arrows (514) and edge region pressure arrows (516), thereby removing IC layer material at a faster rate from the central region of the wafer (506) than from the edge region of the wafer. In a preferred embodiment, a maximum local pressure between the polishing pad (500) and the IC layer (508) is maintained at a safe fraction of the critical pressure related to defect generation during the CMP operation by adjusting a downward force on the head (504). Lateral motion of the head (504) across the polishing pad (500) is denoted by the head motion arrow (518).

FIG. 5C depicts the CMP operation near its completion. Due to the local pressure between the polishing pad (500) and the IC layer (508) being higher in the central region of the wafer (506), more IC layer material is removed from the central region of the wafer (506), bringing the radially averaged layer thickness profile (510) close to the desired layer thickness profile (512). Local pressure across the wafer (506) is more equal compared to a local pressure distribution at the start of the CMP operation, as denoted by a second set of pressure arrows (520).

At the completion of the CMP process depicted in FIG. 5A through FIG. 5C, the radially averaged layer thickness profile of the IC layer (508) is substantially equal to the desired layer thickness profile (512).

Figure 6:
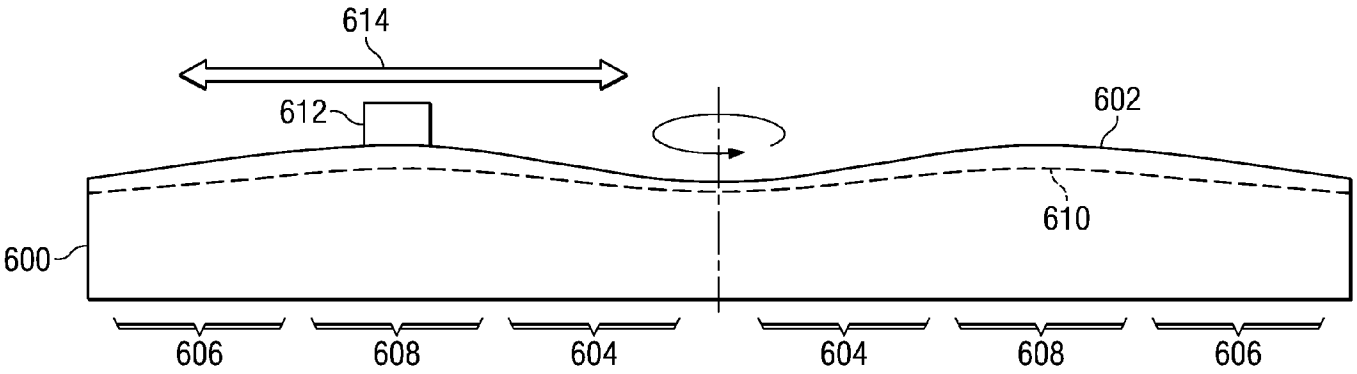
FIG. 6 depicts a polishing pad after one or more CMP operations, during a conditioning operation to restore the polishing pad to a desired profile.

During a CMP operation as described in reference to FIG. 5A through FIG. 5C, polishing pad material is removed in a pattern that causes a radially averaged polishing pad thickness profile to deviate from a desired polishing pad thickness profile. FIG. 6 depicts a polishing pad (600) after one or more CMP operations, during a conditioning operation to restore the polishing pad to a desired profile. A radially averaged polishing pad thickness profile (602) is thinner in a center region (604) and an edge region (606) than in a mid region (608) compared to a desired polishing pad thickness profile (610). The polishing pad rotates around a vertical axis through its center. A conditioning block (612) moves laterally on a top surface of the polishing pad (600), as indicated by conditioning block movement arrow (614). Polishing pad material is removed by the conditioning block (612), as described in reference to FIG. 3. In the instant conditioning operation, a sweep pattern for the conditioning block (612) is generated which removes more polishing pad material from the mid region (608) than from the center region (604) and edge region (606). When the instant conditioning operation is completed, a radially averaged polishing pad thickness profile is substantially equal to the desired polishing pad thickness profile (610).

Figure 7:
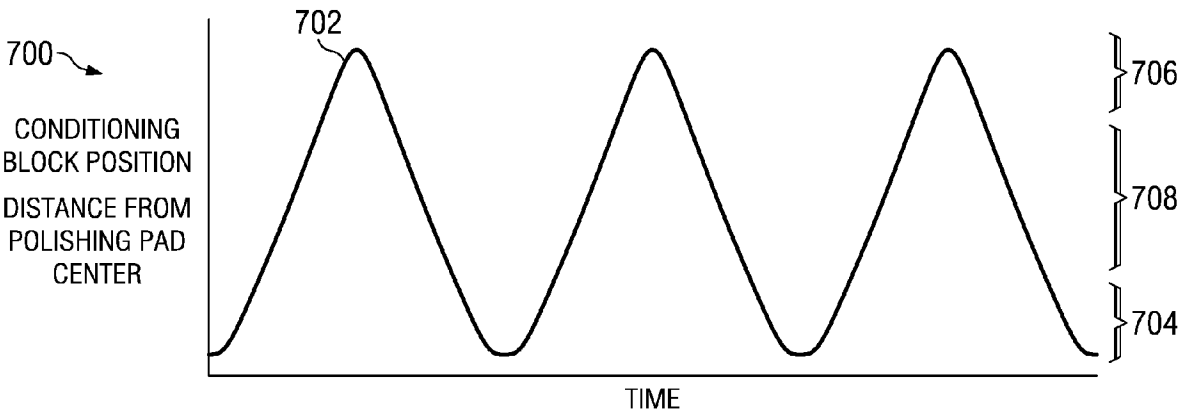
FIG. 7 is a chart of a restoring sweep pattern for a conditioning block to restore a used polishing pad to a desired thickness profile.

FIG. 7 is a chart (700) of a restoring sweep pattern (702) for a conditioning block to restore a used polishing pad to a desired thickness profile, for example, the polishing pad depicted in FIG. 6. The restoring sweep pattern (702) specifies the conditioning block to spend less than one fourth of a sweep cycle in a region near a central endpoint (704), and spend less than one fourth of the sweep cycle in a region near an edge endpoint (706), while spending more than half of the sweep cycle in a mid region (708). Such a restoring sweep pattern (702) may be expected to remove less polishing pad material from a center region and an edge region of a polishing pad compared to a mid region of the polishing pad.

In one embodiment, a maintenance sweep may be implemented on a CMP tool during a CMP operation, whereby a conditioning block continuously maintains a desired thickness profile on a polishing pad while wafers are polished. In an alternate embodiment, a restoring sweep may be implemented between wafer polish CMP operations.

Radially averaged polishing pad thickness profiles may be obtained by known methods of surface profilometry, optical interferometry, mechanical gauging, or other technique. New methods of obtaining a radially averaged polishing pad thickness profile are being developed. It is within the scope of the instant invention to obtain a radially averaged polishing pad thickness profile by any method, including a method yet to be developed at the time the instant disclosure is written.

In a further embodiment, after a polishing pad has been used in a series of CMP operations, the process of obtaining a radially averaged polishing pad thickness profile and generating a restoring sweep to restore the polishing pad to a desired polishing pad thickness profile may produce a determination that the polishing pad should be replaced.

Similarly, in another embodiment, a pad material removal rate may be measured for a conditioning block, and a determination may be made that the conditioning block should be replaced.

What is claimed is:

1. A method of conditioning a polishing pad, comprising the steps of:

measuring a radially averaged thickness profile of an integrated circuit (IC) layer on a wafer to be polished using said polishing pad;

estimating a radial profile of IC layer material of said IC layer to be removed in a chemical mechanical polish (CMP) operation using said polishing pad by subtracting a desired thickness profile of said IC layer from said radially averaged thickness profile;

estimating a desired polishing pad thickness profile by a process further comprising the steps of:

computing a removal rate of said IC layer material as a function of distance from a center of said wafer; and computing a polishing pad thickness as a function of distance from a center of said polishing pad required to obtain said removal rate of said IC layer material;

measuring a radially averaged polishing pad thickness profile of said polishing pad;

computing a conditioning sweep pattern for a conditioning block by a process further comprising the steps of:

estimating a radial profile of polishing pad material to be removed from said polishing pad by subtracting said desired polishing pad thickness profile from said measured radially averaged polishing pad thickness profile;

computing a removal rate of said polishing pad material from said polishing pad by said conditioning block as a function of distance from a center of said polishing pad; and computing a sweep pattern for said conditioning block which removes a desired amount of said polishing pad material such that a conditioning process using said sweep pattern will produce said desired polishing pad thickness profile on said polishing pad; and performing a conditioning process comprising the step of moving said condition block on said polishing pad in said conditioning sweep pattern.

2. The method of claim 1, wherein said step of computing a removal rate of said IC layer material as a function of distance from a center of said wafer takes into account a constraint of limiting an estimated local pressure between said polishing pad and said IC layer to a desired value.

3. The method of claim 2, in which said IC layer material is silicon dioxide.

4. The method of claim 2, in which said IC layer material is copper.

5. The method of claim 2, in which said IC layer material is tungsten.

6. A method of polishing a wafer, comprising the steps of:

measuring a radially averaged thickness profile of an IC layer on said wafer to be polished using a polishing pad;

estimating a radial profile of IC layer material of said IC layer to be removed in a CMP operation using said polishing pad by subtracting a desired thickness profile of said IC layer from said radially averaged thickness profile;

estimating a desired polishing pad thickness profile by a process further comprising the steps of:

computing a removal rate of said IC layer material as a function of distance from a center of said wafer; and computing a polishing pad thickness as a function of distance from a center of said polishing pad required to obtain said removal rate of said IC layer material;

measuring a radially averaged polishing pad thickness profile of said polishing pad;

computing a conditioning sweep pattern for a conditioning block by a process further comprising the steps of:

estimating a radial profile of polishing pad material to be removed from said polishing pad by subtracting said desired polishing pad thickness profile from said measured radially averaged polishing pad thickness profile;

computing a removal rate of said polishing pad material from said polishing pad by said conditioning block as a function of distance from a center of said polishing pad; and computing a sweep pattern for said conditioning block which removes a desired amount of said polishing pad material such that a conditioning process using said sweep pattern will produce said desired polishing pad thickness profile on said polishing pad;

performing a conditioning process comprising the step of moving said conditioning block on said polishing pad in said conditioning sweep pattern; and polishing said wafer using said polishing pad such that said IC layer attains said desired thickness profile.

7. The method of claim 6, wherein said step of computing a removal rate of said IC layer material as a function of distance from a center of said wafer takes into account a constraint of limiting an estimated local pressure between said polishing pad and said IC layer to a desired value.

8. The method of claim 7, wherein said step of polishing said wafer further comprises the steps of:

measuring an in-process radially averaged polishing pad thickness profile of said polishing pad while polishing said wafer;

computing a maintenance sweep pattern for a conditioning block by a process further comprising the steps of:

estimating a maintenance radial profile of polishing pad material to be removed from said polishing pad by subtracting said desired polishing pad thickness profile from said measured in-process radially averaged polishing pad thickness profile; and computing a second sweep pattern for said conditioning block which removes a desired amount of said polishing pad material such that using said sweep pattern while polishing said wafer will maintain said desired polishing pad thickness profile on said polishing pad; and moving said conditioning block on said polishing pad in said maintenance sweep pattern while polishing said wafer.

9. The method of claim 8, in which said IC layer material is silicon dioxide.

10. The method of claim 8, in which said IC layer material is copper.

11. The method of claim 8, in which said IC layer material is tungsten.

12. A method of polishing a plurality of wafers, comprising the steps of:

measuring a radially averaged thickness profile of a first IC layer on a first wafer to be polished using a polishing pad;

estimating a radial profile of first IC layer material of said first IC layer to be removed in a CMP operation using said polishing pad by subtracting a desired thickness profile of said first IC layer from said radially averaged thickness profile;

estimating a desired polishing pad thickness profile by a process further comprising the steps of:

computing a removal rate of said first IC layer material as a function of distance from a center of said first wafer; and computing a polishing pad thickness as a function of distance from a center of said polishing pad required to obtain said removal rate of said first IC layer material;

measuring a first radially averaged polishing pad thickness profile of said polishing pad;

computing a pre-conditioning sweep pattern for a conditioning block by a process further comprising the steps of:

estimating a radial profile of polishing pad material to be removed from said polishing pad by subtracting said desired polishing pad thickness profile from said measured first radially averaged polishing pad thickness profile;

computing a removal rate of said polishing pad material from said polishing pad by said conditioning block as a function of distance from a center of said polishing pad; and computing a sweep pattern for said conditioning block which removes a desired amount of said polishing pad material such that a conditioning process using said sweep pattern will produce said desired polishing pad thickness profile on said polishing pad;

performing a pre-conditioning process comprising the step of moving said conditioning block on said polishing pad in said pre-conditioning sweep pattern;

polishing said first wafer using said polishing pad such that said first IC layer attains said desired thickness profile;

measuring a second radially averaged polishing pad thickness profile of said polishing pad;

computing a restoring conditioning sweep pattern for a conditioning block by a process further comprising the steps of:

estimating a radial profile of polishing pad material to be removed from said polishing pad by subtracting said desired polishing pad thickness profile from said measured second radially averaged polishing pad thickness profile; and computing a sweep pattern for said conditioning block which removes a desired amount of said polishing pad material such that a restoring process using said sweep pattern will produce said desired polishing pad thickness profile on said polishing pad;

performing a restoring process comprising the step of moving said conditioning block on said polishing pad in said restoring sweep pattern;

polishing a second wafer comprising a second IC layer using said polishing pad such that said second IC layer attains said desired thickness profile.

13. The method of claim 12, wherein said step of computing a removal rate of said first IC layer material as a function of distance from a center of said wafer takes into account a constraint of limiting an estimated local pressure between said polishing pad and said first IC layer to a desired value.

14. The method of claim 13, wherein said step of polishing said second wafer further comprises the steps of:

measuring an in-process radially averaged polishing pad thickness profile of said polishing pad while polishing said second wafer;

computing a maintenance sweep pattern for a conditioning block by a process further comprising the steps of:

estimating a maintenance radial profile of polishing pad material to be removed from said polishing pad by subtracting said desired polishing pad thickness profile from said measured in-process radially averaged polishing pad thickness profile; and computing a second sweep pattern for said conditioning block which removes a desired amount of said polishing pad material such that using said sweep pattern while polishing said second wafer will maintain said desired polishing pad thickness profile on said polishing pad; and moving said conditioning block on said polishing pad in said maintenance sweep pattern while polishing said second wafer.

15. The method of claim 14, in which said step of estimating a maintenance radial profile of polishing pad material to be removed from said polishing pad further comprises the step of determining if said polishing pad should be replaced.

16. The method of claim 15, in which said IC layer material is silicon dioxide.

17. The method of claim 15, in which said IC layer material is copper.

18. The method of claim 15, in which said IC layer material is tungsten.

* * * * *